United States Patent [19]

Francioni

[11] Patent Number: 4,955,184

[45] Date of Patent: Sep. 11, 1990

[54] METHOD AND EQUIPMENT FOR FORMING MULTIPLE PACKS OF PRODUCTS, PARTICULARLY FOOD PRODUCTS

[75] Inventor: Renzo Francioni, Prato Sesia, Italy

[73] Assignee: Cavanna S.p.A., Italy

[21] Appl. No.: 367,877

[22] Filed: Jun. 19, 1989

[30] Foreign Application Priority Data

Feb. 13, 1989 [IT] Italy ..... 67083 A/89

[51] Int. Cl.[5] ..... B65B 9/06; B65B 35/40; B65G 47/24

[52] U.S. Cl. ..... 53/448; 53/450; 53/531; 53/550

[58] Field of Search ..... 53/236, 443, 448, 450, 53/531, 543, 550, 542; 198/419.1

[56] References Cited

U.S. PATENT DOCUMENTS

| | | | |
|---|---|---|---|
| 3,178,007 | 4/1965 | Standley et al. | 53/531 X |
| 3,194,382 | 7/1965 | Nigrelli et al. | 53/543 X |
| 3,402,524 | 9/1968 | Griner | 53/550 X |
| 3,454,149 | 7/1969 | Nigrelli et al. | 53/448 X |
| 3,503,175 | 3/1970 | Marasso et al. | 53/412 |
| 3,513,629 | 12/1967 | Hoagland et al. | 53/531 X |
| 3,760,553 | 9/1973 | Schmidt, Sr. et al. | 53/448 |
| 4,549,662 | 10/1985 | Schoenig, Jr. et al. | 198/419.1 X |
| 4,660,350 | 4/1987 | Hogenkamp . | |

FOREIGN PATENT DOCUMENTS

| | | | |
|---|---|---|---|
| 902490 | 6/1972 | Canada | 53/450 |
| 0077302 | 11/1985 | European Pat. Off. . | |
| 324556 | 1/1930 | United Kingdom . | |
| 197811 | 11/1978 | United Kingdom | 53/550 |
| 2100212 | 12/1982 | United Kingdom . | |

*Primary Examiner*—Robert L. Spruill
*Assistant Examiner*—Beth Bianca
*Attorney, Agent, or Firm*—Evenson, Wands, Edwards, Lehanan & McKeown

[57] ABSTRACT

Products to be formed into multiple packs are advanced, evenly spaced, towards a wrapper-forming zone and the flow of products is stopped cyclically within the zone so as to cause the formation of groups of products which are substantially packed together for insertion in respective packages.

15 Claims, 2 Drawing Sheets

Figure 2:
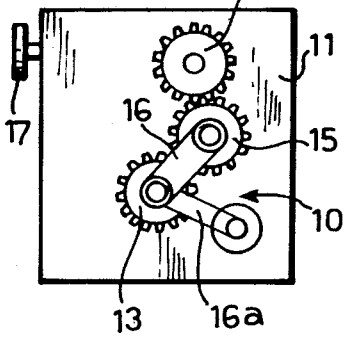

METHOD AND EQUIPMENT FOR FORMING MULTIPLE PACKS OF PRODUCTS, PARTICULARLY FOOD PRODUCTS

DESCRIPTION

The present invention relates to packaging techniques and is particularly concerned with a method for forming, from a flow of products, multiple packs each including a group constituted by a given number of products collected in a tubular wrapper which is closed at its ends by welding, in which the wrapper is formed in a predetermined zone and is closed by the welding of its ends in a closure zone situated downstream of the predetermined zone in the direction of flow of the products and having a given length in that direction.

In this connection, because it is necessary to provide a space in which the welding and cutting unit for welding the ends can operate, there is the problem that the group of products to be inserted in a package must be separated from the flow of products arriving immediately upstream.

This problem has been tackled several times in the past, particularly in relation to the production of so-called "multipack" packages in which a group of products that are not wrapped (that is, not packaged) or are already inserted each in respective package of the type currently known as a "flow-pack" is inserted in a similar package of larger dimensions.

For example, in European patent No. 0 077 302 in the name of the same Applicant, this problem is resolved by supplying the products from a so-called store (for example, a slide or chute) and removing them therefrom either by means of a blade conveyor whose blading has periodic gaps in correspondence with the separating spaces which are to be created between successive groups of products, or by means of a blade conveyor which moves intermittently and transfers the products to a continuously-movable conveyor situated downstream; as a result of the periodic interruption of the movement of the blade conveyor, separating spaces or gaps are formed regularly between successive groups of products on the downstream conveyor.

In Italian patent application Ser. No. 21295-A/88, the same problem is resolved by the transfer of the products from an input storage conveyor to an output conveyor by means of a device comprising a plurality of blades carried by an endless chain conveyor. Each blade of the transfer device can be withdrawn, under the action of operating means, from an active position in which it interferes with the stored products, and therefore achieves the transfer to the output conveyor, to an inactive position in which the blade does not act on the products and causes gap to form in the output flow.

Whilst being wholly satisfactory from the functional point of view, these previously known solutions do not cater for all the possible situations of use.

For example, in some types of system, it is not possible to produce stores of the type described in European patent No. 0 077 302.

In the solution described in Italian application Ser. No. 21295A/88, on the other hand, the transfer device with orientable blades must move at a speed which corresponds to the net supply rate of the products (number of packages per minute×number of products in each package) multiplied by a factor which takes account of the ratio between the space occupied by each package as a whole (occupied space+empty space, that is, the gap separating successive groups of products) and the number of products in each package.

Thus, if multipack packages separated by a gap equal to the width of one product and each including a group of seven products are produced, this increase ratio is equal to 8/7. However, the ratio becomes 4/3 if packages separated by a gap equal to the width of one product and each including a group of three products are produced, or even to 3/2 in the case of packages with a similar spacing but each including only two products.

When operating at very high net output rates, this multiplication effect can mean that the transfer device must work at speeds which are incompatible with the reliability and safety requirements experienced in the field, as well as with the integrity of the products being handled.

The object of the present invention, therefore, is to provide a method for forming multiple packages of the type specified which does not give rise to the problems described above.

According to the present invention, this object is achieved by virtue of a method of the type specified above, characterised in that it comprises the steps of:

-advancing the flow of products towards the predetermined zone with a uniform distance between successive products in the flow, the distance being determined by the ratio between the given length (that is, the length of the welding zone) and the given number of products, and -substantially stopping the movement of one of the given number of products in correspondence with the predetermined zone (that is, the wrapper-forming zone) so as to cause the formation of a group of products which are substantially packed together and the consequent formation, between two successive groups of products each including the given number of products, of a gap substantially equal in length to the given length of the closure zone.

Another subject of the invention is equipment which enables the method specified above to be carried out.

Figure 1:
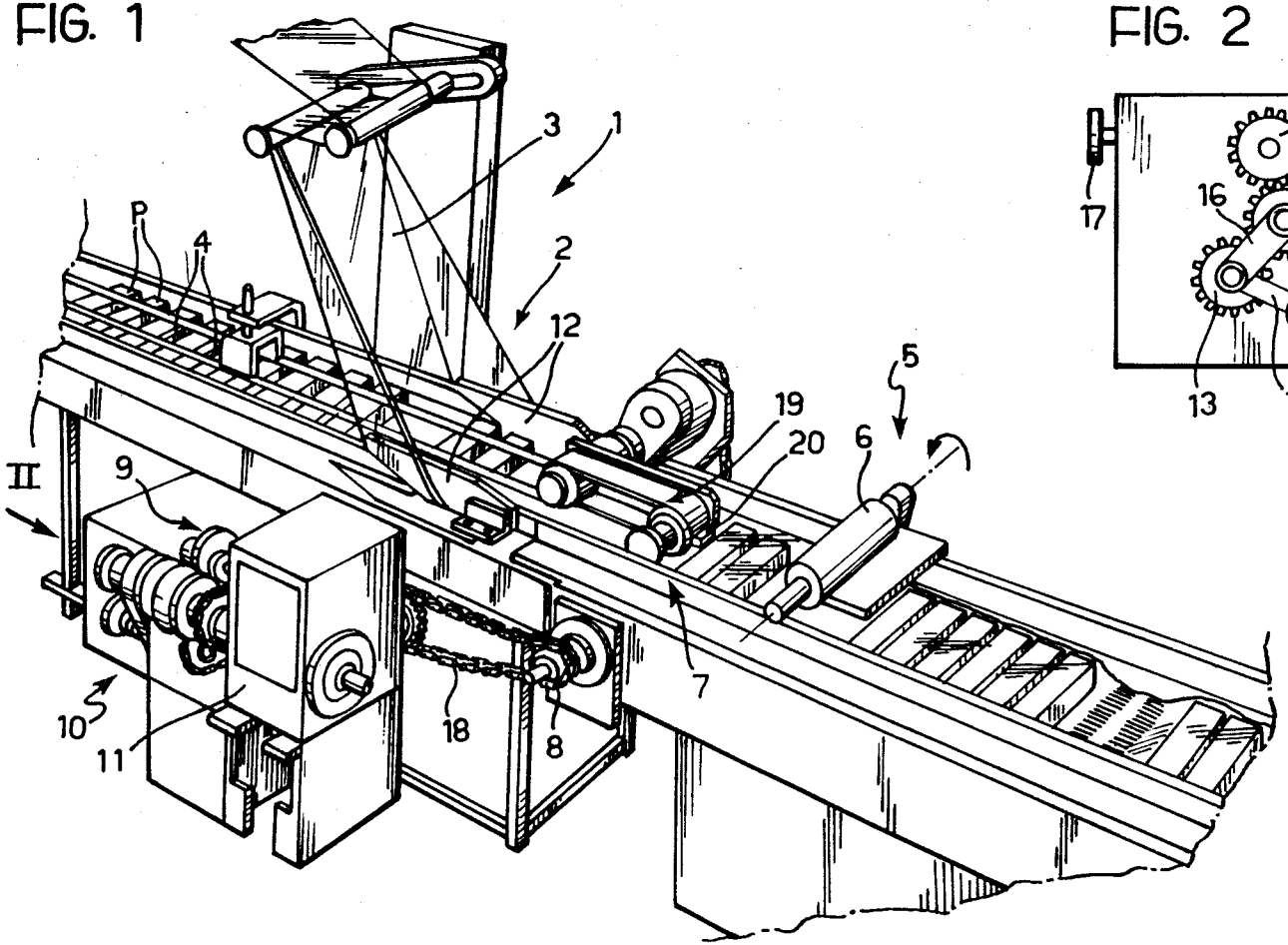

The invention will now be described, purely by way of non-limiting example, with reference to the appended drawings, in which:

FIG. 1 shows schematically the structure of packaging equipment produced according to the invention, FIG. 2 is a partial view of FIG. 1, taken on the arrow II of FIG. 1, and FIGS. 3 to 6 show schematically the operating sequence of the equipment according to the invention, at successive times.

In FIG. 1, a packaging machine of the type currently known as a "flow-pack" or a "form-fill-seal" machine is generally indicated 1.

The structure and operating principles of such a machine must be considered widely known and therefore such as not to require a detailed description herein.

By way of summary, the operation of the equipment provides for the advance of a substantially continuous flow of products P (for example, chocolate bars or chocolate-covered cakes, preferably already in "flow-pack" type packages) towards a wrapper-forming station 2 where a packaging membrane or film 3 is supplied from above and is closed so as to form a tubular wrapper which surrounds the products P.

The products P are advanced positively towards the wrapper-forming station 2, for example, by means of a blade conveyor 4 whose blades are regularly spacedapart by a distance slightly greater than the width (measured in the direction of advance) of the products P.

More precisely, the distance between the blades of the conveyor 4 is selected so that a space d selected according to criteria which will better be described below is left between two products P supplied in succession to the wrapper-forming station 2.

The entrainment achieved by the conveyor 4, and the conveyor itself, usually end in correspondence with the wrapper-forming station 2. Since it is wound around the products P, the film or membrane 3 in fact ensures the entrainment of the products P towards a welding station 5. At this latter station, a pair of rotary jaws or blades 6 (only one of which, that is, the one situated above the flow of products P, is visible in FIG. 2) close the packages by forming two transverse welds at the ends of each one and also separate the packages from each other, in succession, by a cutting action.

In general, the operating zone of the welding station 5 (that is, the region in which the jaws or blades 6 act on the membrane or film 3) has a certain length D (measured in the direction of advance of the products P in this case also).

In order to enable the closure of the packages to be achieved correctly, therefore, it is necessary to arrange for gaps of a length which practically corresponds to the length D defined above to be produce cyclically in the flow of products advancing towards the welding station 5.

The equipment 1 is intended to form packages of the "multipack" type, each of which contains a number n of products.

As stated above, the products P are supplied from the blade conveyor 4, a uniform distance of length d being kept between successive products. This distance is selected so that $d=D/n$, for reasons which will be made clearer below.

A retaining element, indicated 7 in the drawings (see particularly FIGS. 4 to 6), is constituted substantially by a tooth or blade mounted in a generally flag-like configuration on a horizontal drive shaft 8.

The shaft in question is driven by the main drive unit of the machine, schematically shown in the form of a shaft 9 in FIG. 1, through a speed-varying mechanism comprising in cascade:

-a unit 10 for effecting the variable oscillation of the speed of movement, and -a unit 11 with cams or eccentrics (preferably of the type currently known as a Ferguson mechanism) which enables the rotary movement of the shaft 8, and hence the orbital movement of the retaining element 7, to be stopped periodically according to criteria which will better be described below.

The retaining element 7 is arranged in correspondence with the wrapper-forming station 2, usually at a point where the film or membrane 3 has already completely surrounded the products and/or is securely entrianing them forwards to the welding station 5.

By way of reference, it may be considered that the retaining element 7 is situated downstream of the so-called "feeder" 12 which folds the wrapper into a tube, at a distance approximately corresponding to the length of the packages which are to be formed.

The oscillating mechanism 10 (which is of known type) comprises:

-a driving gear 13 driven by the main shaft 9 (for example, through a chain transmission not shown clearly in the drawings), -a driven gear 14 which drives the input shaft of the Ferguson mechanism 11, -an intermediate gear 15 which meshes with both the gears 13 and 14, and -an arm 16 which supports the intermediate gear and enables it to perform an alternating orbital movement about the axis of rotation of one of the gears 13 or 14 (in the example illustrated, the driven gear 13).

The amplitude and frequency of oscillation of the arm 16 and hence of the gear 15 are controlled by an entrainment mechanism **16*a*, also of known type. The latter is usually driven by the Ferguson mechanism 11 whose output shaft drives the shaft 8 which causes the movement of the retaining element 7, by means of a gear 17 and a chain 18**.

The oscillation of the gear 15 has the effect of making the rate of rotation of the driven wheel 14 vary periodically relative to the speed of the driving gear 13 which is driven by the drive unit of the machine as a whole (the shaft 9).

As a result of the movement of the gear 14, which is substantially continuous even though its speed oscillates, the Ferguson mechanism 11 imparts to the shaft 8, and hence to the element 7, a cyclic movement in which there can be distinguished essentially:

-an insertion stroke into the flow of products P, in which the retaining element 7 rises from below and follows the products P at a given speed as they advance towards the welding station 5, until it is inserted between them;

-a stage of substantial stoppage, in which the retaining element 7 resists the forward movement of the products P, and -a withdrawal stroke in which the retaining element 7 is removed from the flow of products so as to enable the products P to advance again towards the welding station 5.

It is possible selectively to adjust the duration of the stoppage of the flow of products P, as well as the speed of insertion of the stop element into the flow of products, by acting on the mechanism 10, 11.

A separator device (the use of which is not strictly necessary for the purposes of the invention) is generally indicated 19 and is constituted by an endless belt situated above the flow of products P in correspondence with the wrapper-closure zone 2. The belt in question is provided with formations, such as teeth or blades 20, which can be inserted into the flow of products P (already surrounded by the membrane or film 3) from above by a certain vertical distance, so as to keep separate the groups of products P which are to be inserted in different packages.

The movement of the separator device 19, which is also driven by the general drive unit of the machine (through a known mechanism, not explicitly shown in the drawings), is synchronised with the movement of the retaining element 7 (which is on the opposite side of the flow of products P) according to operating criteria illustrated in the sequence of FIGS. 3 to 6.

Figure 3:
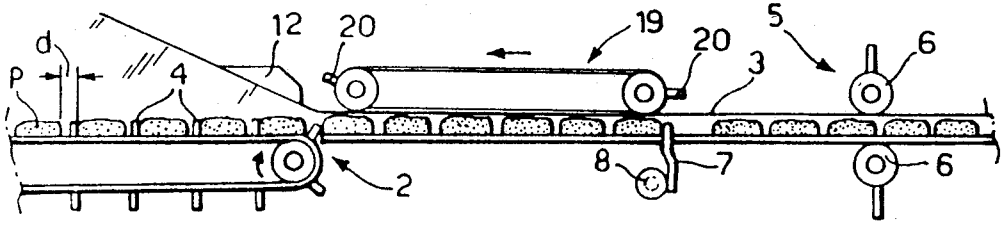

FIG. 3 shows an operating condition in which a flow of products P separated by the distance d has arrived, without any substantial alteration in the distance between consecutive products, in the region where the retaining element 7 acts. The latter has just reached the position in which it interferes with the flow of products P by rising from below as a result of the rotation of the shaft 8.

The product immediately upstream of the element 7 in the flow thus comes into contact with the element 7 and stops in abutment with it, enabling the products arriving upstream gradually to be packed together.

At the same time, a group of products further downstream of the element 7 continues its movement towards the welding station 5, entrained by the film or membrane 3.

As a result of the stopping action achieved by the element 7, a group of products which are packed together and therefore no longer separated by the distance d (FIG. 4) is formed immediately upstream of the element 7.

Figure 5:
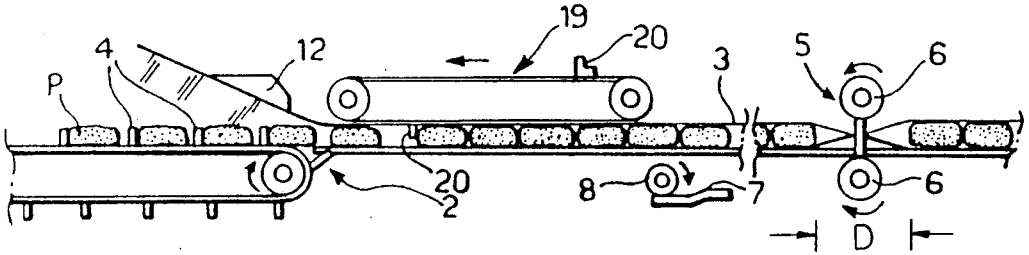
Figure 6:
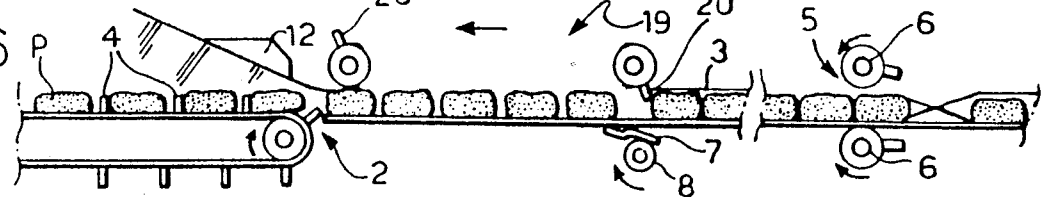

The gradual accumulation of products packed together continues until the retaining element 7 is lowered again as a result of the rotation of the shaft 8, enabling the products P to move on towards the welding station 5 (FIG. 5).

Figure 4:
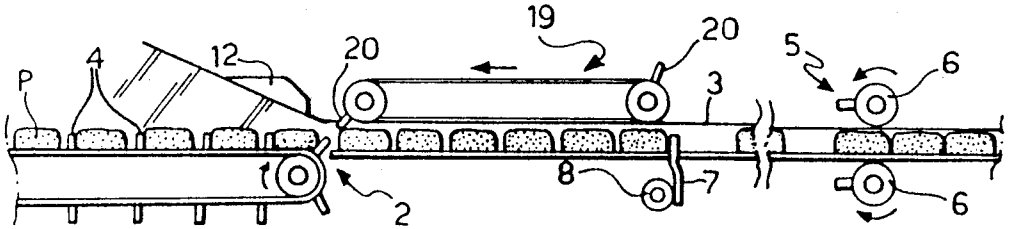

The duration of the period during which the retaining element 7 remains in the position of FIG. 4, in which the flow is stopped, is selected in relation to the rate of advance of the products, so that the number of products P packed together upstream of the element 7 is exactly equal to the number n of products to be inserted in each package.

The effect of the packing together of n successive products P is the formation, downstream of the retaining element 7, of a space or gap whose length is exactly equal to the product of the number n of products packed together and the distance d which separates the products in the flow supplied to the wrapper-forming station 2. This product, $n \times d$, corresponds exactly to the gap D which is to be formed between two groups of products for insertion in two successive packages.

The groups of products which are packed together are then advanced downstream of the retaining element 7, which is lowered (FIG. 5), separated by the distance D which enables the jaws or blades 6 of the welding station 5 to perform their task correctly.

As it completes its cyclic rotary motion about the shaft 8, the stop element gradually returns (see FIG. 6) towards the initial condition shown in FIG. 3. At the same time (still with reference to the situation shown in FIG. 6), a new group of products P separated or spread out by the distance d collects in the wrapper-forming station 2 for subsequent packing together as a result of the retaining action of the element 7.

The function of the separator device 19, and more precisely of the formations 20, is to be inserted periodically into the flow of products P so as to be located, so to speak, behind the last product P which will be packed together with a preceding group of products to complete the group for insertion in a package.

The device 19 therefore has the function of stabilising the movement of the products P at the end of the packing-together stage. This is in order to prevent any rebounding of the last of the products which are being packed together to form a group, which could give rise to incorrect positioning and a risk of subsequent interference with the element 7.

It should also be noted that, when the number n of products inserted in each package is low (for example, three) the distance d between the products P introduced is itself such as to prevent the problems described above from arising in any case: in this situation, the use of the device 19 is therefore not necessary for the correct operation of the equipment according to the invention.

The use of the device 19 is preferable, however, in situations in which the number n is increased (for example, when n is equal to 7 or 8) and the distance d is reduced correspondingly. The length D of the operating zone of the welding station is practically constant and largely independent of the number of products contained in each package.

Naturally, the principle of the invention remaining the same, the forms of embodiment and details of construction may be varied widely with respect to those described and illustrated, without thereby departing from the scope of the present invention.

What is claimed is:

1. A method of forming, from a flow of products, multiple packs each including a group constituted by a given number of said products collected in a tubular wrapper which is closed at its ends by welding, in which it includes the steps of forming the wrapper in a predetermined zone and closing the wrapper by the welding of its ends in a closure zone situated downstream of the predetermined zone in the direction of flow of the products, said closure zone having a given length in that direction, wherein the method further includes the steps of:

continuously advancing the flow of products towards the predetermined zone while maintaining a uniform distance between successive products in the flow in a first zone, the distance being determined by the ration between the given length and the given number of products;

continuously advancing the flow of products toward the predetermined zone along a second zone;

substantially stopping the movement of one of the given number of products while the one product is in the second zone, so as to cause the formation of a group of products by the products being advanced in the second zone in a spaced relationship until their advancement is stopped by abutment up against the one stopped products or a product stopped by abutment with stopped products abutting the one stopped product, until the number of stopped products equals the number of products for the group;

then releasing the one stopped products so that the group of stopped products are again continuously moved, in unison packed together, toward the closure zone as a group of products;

wherein the releasing of the one stopped product to allow the continuous advancing to be resumed, provides successive groups of products each including the given number of products and separated by a gap substantially equal in length to the given length of the closure zone.

2. A method according to claim 1, wherein it includes the step of inserting a separator element into the flow of products immediately downstream of the said one of the given number of products which is to be stopped, before the stoppage, so as to keep substantially separate two successive groups of products each comprising the given number of products.

3. Equipment for forming, from a flow of products, multiple packs each including a group constituted by a given number of products collected in a tubular wrapper which is closed at its ends by welding, including:

-means for forming the wrapper, and

-wrapper-closing means situated downstream of the forming means in the direction of flow of the products for welding said wrapper in a closure zone having a given length in that direction, wherein it further includes:

-conveyor means for supplying the products to the wrapper-forming means while maintaining a uniform distance between successive products in the flow through a first zone, the distance being determined by the ratio between the given length and the given number of products;

and for continuously conveying the products through a second zone;

a product-retaining element which is situated in the second zone and in correspondence with the wrapper-forming means and which can be actuated to substantially stop the movement of one of the given number of products while the remaining products in the second zone continue to move until they abut up against the one stopped product or product(s) stopped by abutting the one stopped product, so as to cause the formation of a group of products which are substantially packed together;

and wherein the product-retaining element is released when the number of stopped products equals the number of products in the group to permit the group of products to be conveyed in unison and packed together to the wrapper closing means and the consequent formation, between two successive groups of products each comprising the given number of products, of a gap substantially equal in length to the given length of said closure zone.

4. Equipment according to claim 3, wherein the conveyor means include at least one conveyor with entraining formations which spacing determines the given uniform distance between successive products.

5. Equipment according to claim 3, wherein the retaining element comprises at least one tooth-shaped formation which can be inserted into the flow of products.

6. Equipment according to claim 3, wherein the retaining element is constituted essentially by a flag-like body mounted for rotation about a respective axis.

7. Equipment according to claim 3, wherein it includes means for synchronising the retaining element with the conveyor means, the synchronising means being associated with the retaining element and being capable of imparting to the retaining element a cyclic movement comprising:

-an insertion stroke into the flow of products, in which the retaining element follows the products at a given speed as they advance towards the closure means, -a stage of substantial stoppage of predetermined duration, in which the retaining element resists the forward movement of the products, and -a withdrawal stroke in which the retaining element is removed from the flow of products so as to enable the products to advance again towards the closure means.

8. Equipment according to claim 7, wherein the synchronising means include adjustment means for selectively varying at least one of the given speed and the given predetermined duration.

9. Equipment according to claim 7, wherein the synchronising means comprise cam means.

10. Equipment according to any one of claim 7, wherein the synchronising means comprise at least one Ferguson mechanism.

11. Equipment according to claim 7, wherein the synchronising means include gears interposed between the conveyor means and the retaining element and comprising a driving gear, a driven gear, and an intermediate gear which is meshed with the driving gear and the driven gear and is capable of an alternating orbital movement about the driving gear or the driven gear, the orbital movement causing a variation in the rate of rotation of the driven gear relative to the rate of rotation of the driving gear.

12. Equipment according to claim 3, wherein a separation device is associated with the conveyor means, at least in correspondence with the forming means, and is situated upstream of the retaining element in the direction of flow of the products, the separator device being insertable into the flow of products immediately downstream of the said one of the given number of products to be stopped, so as to keep substantially separate two successive groups of products each comprising the given number of products.

13. Equipment according to claim 12, wherein the separator device comprises an endless belt with an active pass which can move substantially in synchronism with the conveyor means in a position facing the products, tooth-shaped formations being provided on the belt which can be inserted into the flow of products.

14. Equipment according to claim 12, wherein the separator device and the retaining element are arranged on opposite sides of the flow of products.

15. Equipment according to claim 12, wherein the forming means insert the tubular wrapper between the products and the separator device.

* * * * *